US006078028A

United States Patent [19]

Cooper et al.

[11] Patent Number: 6,078,028

[45] Date of Patent: Jun. 20, 2000

[54] SOLDERLESS CERAMIC IGNITER HAVING A LEADFRAME ATTACHMENT

[75] Inventors: John Cooper, New Braintree; Bela Nagy, Acton; David Shum, Northboro, all of Mass.; Brian Kochan, Milford; Scott Hamel, Wilton, both of N.H.

[73] Assignee: Saint-Gobain Industrial Ceramics, Inc., Worcester, Mass.

[21] Appl. No.: 09/253,376

[22] Filed: Feb. 19, 1999

[51] Int. Cl.[7] ..... F23Q 7/22; H05B 3/03

[52] U.S. Cl. ..... 219/270; 219/541; 219/552; 338/329; 338/332; 228/124.1; 29/611; 29/621

[58] Field of Search ..... 219/270, 260, 219/267, 541, 552, 553; 123/145 A, 145 R; 338/322, 326, 327, 329, 332; 228/124.1, 122.1; 29/611, 621

[56] References Cited

U.S. PATENT DOCUMENTS

| | | | |
|---|---|---|---|
| 3,269,806 | 8/1966 | Fitzer et al. | 219/552 |
| 3,284,879 | 11/1966 | Negre | 29/621 |
| 3,774,077 | 11/1973 | Raffaelli et al. | 219/260 |
| 3,875,477 | 4/1975 | Fredriksson et al. | 219/270 |
| 4,058,789 | 11/1977 | Bavisotto et al. | 219/553 |
| 4,228,344 | 10/1980 | Boos et al. | 219/270 |
| 5,045,237 | 9/1991 | Washburn | 219/270 |
| 5,218,751 | 6/1993 | Chen et al. | 219/270 |
| 5,514,630 | 5/1996 | Willkens et al. | 252/516 |
| 5,564,618 | 10/1996 | Axelson | 228/124.1 |
| 5,705,261 | 1/1998 | Axelson | 219/270 |
| 5,786,565 | 7/1998 | Willkens et al. | 219/260 |
| 5,804,092 | 9/1998 | Axelson et al. | 219/270 |

FOREIGN PATENT DOCUMENTS

| | | | |
|---|---|---|---|
| 486009 | 5/1992 | European Pat. Off. . | |
| 245769 | 5/1987 | Germany | 219/541 |
| 60-29518 | 2/1985 | Japan . | |
| 60-172191 | 9/1985 | Japan . | |
| 2-75187 | 3/1990 | Japan . | |
| 5-182745 | 7/1993 | Japan . | |
| 7-263126 | 10/1995 | Japan . | |

*Primary Examiner*—John A. Jeffery
*Attorney, Agent, or Firm*—Thomas M. DiMauro

[57] ABSTRACT

An electrical connection for a ceramic hot surface element in which the ends of the hot surface element are essentially interference fit within a pair of metallic termination sleeves, and electrical connection to the hot surface element is provided by an active metal braze which is directly chemically bonded to the metallic termination.

49 Claims, 5 Drawing Sheets

SOLDERLESS CERAMIC IGNITER HAVING A LEADFRAME ATTACHMENT

BACKGROUND OF THE INVENTION

Ceramic materials have enjoyed great success as igniters in gas-fired furnaces, stoves and clothes dryers. A ceramic igniter typically includes a ceramic hot surface element having a hairpin or U-shape which contains two conductive end portions and a highly resistive middle portion. When the element ends are connected to electrified leads, the highly resistive middle portion (or "hot zone") rises in temperature.

Since these igniters are resistively heated, each of its ends must be electrically connected to a conductive lead, typically a copper wire lead. However, the problems associated with connecting the ceramic hot surface element ends to leads are well known. One common problem is that the ceramic material and the lead wire do not bond well together. EP 0486009 ("Miller") discloses and FIG. 2 herein presents a conventional igniter system in which a braze 91 is applied to an end of the conductive ceramic 92 by brushing, the braze is then vacuum fired, solder 93 is applied to the braze, and the lead wire 95 is attached to the solder. This solder is typically applied by carefully directing a high temperature (1600–1800° C.) flame upon the end of the brazed ceramic leg, contacting the solder to the hot leg (thereby causing the solder to flow) and then placing the lead wire in the still-liquid solder.

However, the use of solder as described above often causes a host of problems for this technology. First, this method is a very sensitive and time-consuming operation. Second, exposing the hot surface element to the high temperature flame often causes a crack in the igniter. The crack may be due to a coefficient of thermal expansion ("CTE") mismatch between the ceramic hot surface element ("CHSE") and either the solder or the braze. It may also be due to thermal shock of the CHSE. Third, even if the soldering is successful, the resultant solder coverage is typically only on one side of the leg (as shown in FIG. 2). If excessive pressure is applied to the tip of the wire (which occurs frequently in the cementing operation), the lead wire can be pulled free from its bond. Fourth, it is known that, in use, solder is highly susceptible to oxidation and is so frequently the cause of premature aging of the igniter.

Some investigators have tried to manage the problems caused by solder. For example, U.S. Pat. No. 5,564,618 ("Axelson") recognized that the CTE mismatch between the braze and the solder was causing breakage during the soldering step, and sought to minimize the braze by using a silk screening approach. Although this method eliminated some cracks during the soldering step, the three other problems described above remained. Moreover, the small amount of braze necessitated by the Axelson method insured a substantially weaker bond between the braze, solder and wire, leading to substantial failures during pull-off testing.

In another attempt to solve this CTE mismatch problem, the legs of the ceramic hot surface element are dipped into a braze reservoir and then vacuum fired to cure the braze. Ideally, this method should provide a full and even 360 degree coating of the leg, so that the curing of the braze puts the leg into desirable compression. However, because the dipping procedure is inexact, there is typically a large variation in both the coating thickness and the area of coverage, resulting in an undesirable stress distribution. Moreover, the three other problems caused by the use of solder still remain. Lastly, this process uses a large amount of very expensive braze.

Some investigators have tried to eliminate solder from ceramic igniter termination systems. For example, GB 2,095,959 discloses a ceramic block which provides mechanical stability to the hot surface element-wire system. Nichrome wires are physically placed into machined holes or grooves in the hot surface element, and the wires are mechanically held in place by a metallic overlayer which can be either flame-sprayed, galvanized (i.e., plated), or fritted (glass), or nichrome or silver coated. Terminals are attached to the lead wires, and insulation grips are attached to the lead wires. A feature in the block accepts the insulation grips on the wires. The redundancy of mechanical support embodied in the full ceramic block/extensive groove/grip system of GB '959 indicates that this inventor was very concerned that the lead wires would break free from the hot surface element and cause the system to fail.

U.S. Pat. No. 5,804,092 ("Salzer") teaches a modular ceramic igniter system, in which the ceramic hot surface element is plugged into a socket having a conductive contact therein. In some embodiments, these sockets have spring-like contacts which help hold the leg of the ceramic igniter in place. In others, the sockets are tube-shaped. However, each of these systems are plug-in systems which are designed to be temporary and therefore easily pulled apart.

In sum, the use of solder in ceramic igniter systems has caused a host of both process and performance problems. Attempts to design systems which eliminate solder have resulted in either fragile or temporary systems. Therefore, there is a need for a ceramic igniter system having a permanent, solderless electrical connection for ceramic hot surface elements.

SUMMARY OF THE INVENTION

The present inventors have found that using a metallic lead frame to permanently electrically connect an active metal braze-coated CHSE leg to the lead wire has allowed the inventors to eliminate solder from the system and thereby has provided both significant process advantages and performance advantages over the prior art ceramic igniter terminations.

In respect of the process advantages, both the steps of i) connecting the lead frame to the braze and, ii) connecting the lead frame to the lead wire can be fairly robust processes. This allows the assembly to be adapted to automation. As noted above, the conventional method of assembly involved the use of solder and so was highly sensitive to many factors which required human oversight.

In respect of product features, it was found that the present invention possesses a whole host of advantages over the conventional igniter which required a solder interface between the braze and the lead wire. First, the CTE mismatch-induced cracks produced during the soldering step have been eliminated, thereby producing a stronger igniter. Second, the in-use electrical resistivity increases have been substantially decreased, resulting in an effective lifetime of the igniter which is more than about two times that of the conventional solder-containing igniter. Third, the pull-off strength of the igniter, as compared to the silk screening approach, is enhanced because no solder-induced cracking is present. Lastly, the elimination of solder allows the igniter to be used in high temperature environments over about 450° C. (such as range tops and self-cleaning ovens) which would compromise the solder.

Moreover, the particular geometry provided by the lead frame provides special advantages over other metallic termination designs. First, now referring to FIG. 1, the lead frame 5 may include a sleeve 56 into which the leg 1 of the CHSE 3 can be easily inserted. This allows not only accurate and repeatable assembly, the resulting un-fired product is fairly durable and so can withstand more severe production handling. Second, the lead frame can include a circular annulus forming a hole 9 in its roof 55 which not only allows the braze to be applied after insertion of the leg into the lead frame (thereby exactly locating the braze pad without subsequent uncontrolled smearing), it also serves as an guide for both accurately controlling the placement of braze in the middle of the ceramic leg(and thus far away from the edges which are prone to more machining flaws, and for controlling the amount of braze surface coverage. Third, the lead frame may include a Vshaped tab 13 on its back end to which the end 11 of a lead wire can be connected, thereby allowing each lead wire to be collinear with its respective leg of the hot surface element to be placed (leading to a stronger assembly which will not be subject to stresses associated with fixturing the igniter for final assembly).

Therefore, in accordance with the present invention, there is provided an electrical connection for a ceramic hot surface element, comprising:

a) an electroconductive ceramic having a first end, b) an electroconductive active metal braze contacting at least a portion of the first end, and c) a metal termination contacting the active metal braze, wherein the metal termination is chemically bonded to the active metal braze.

In preferred embodiments, the connection is for a ceramic hot surface element, and comprises:

a) an electroconductive ceramic having first and second ends, b) a first electroconductive active metal braze pad contacting at least a portion of the first end, c) a second electroconductive active metal braze pad contacting at least a portion of the second end, d) a first metal termination contacting the first active metal braze pad, and e) a second metal termination contacting the second active metal braze pad, wherein each metal termination is chemically bonded to its corresponding active metal braze.

Also in accordance with the present invention, there is provided a ceramic igniter comprising:

a) an electrically conductive ceramic comprising two cold ends and a resistive zone therebetween;

b) a pair of terminations, each termination comprising a sleeve having a first end and a second end, wherein each end of the electroconductive ceramic is permanently received in the first end of and is in electrical connection with its respective sleeve.

Also in accordance with the present invention, there is provided a process for making a ceramic igniter termination, comprising the steps of:

a) providing a ceramic igniter having first and second ends, each end having an outer surface, b) providing a pair of sleeves, each sleeve having an inner surface corresponding substantially to the outer surface of the first and second ends, c) inserting the first and second ends of the ceramic igniter into the pair of sleeves, d) chemically bonding the inner surface of the sleeve to the outer surface of the leg received therein.

DETAILED DESCRIPTION OF THE INVENTION

Figure 1:
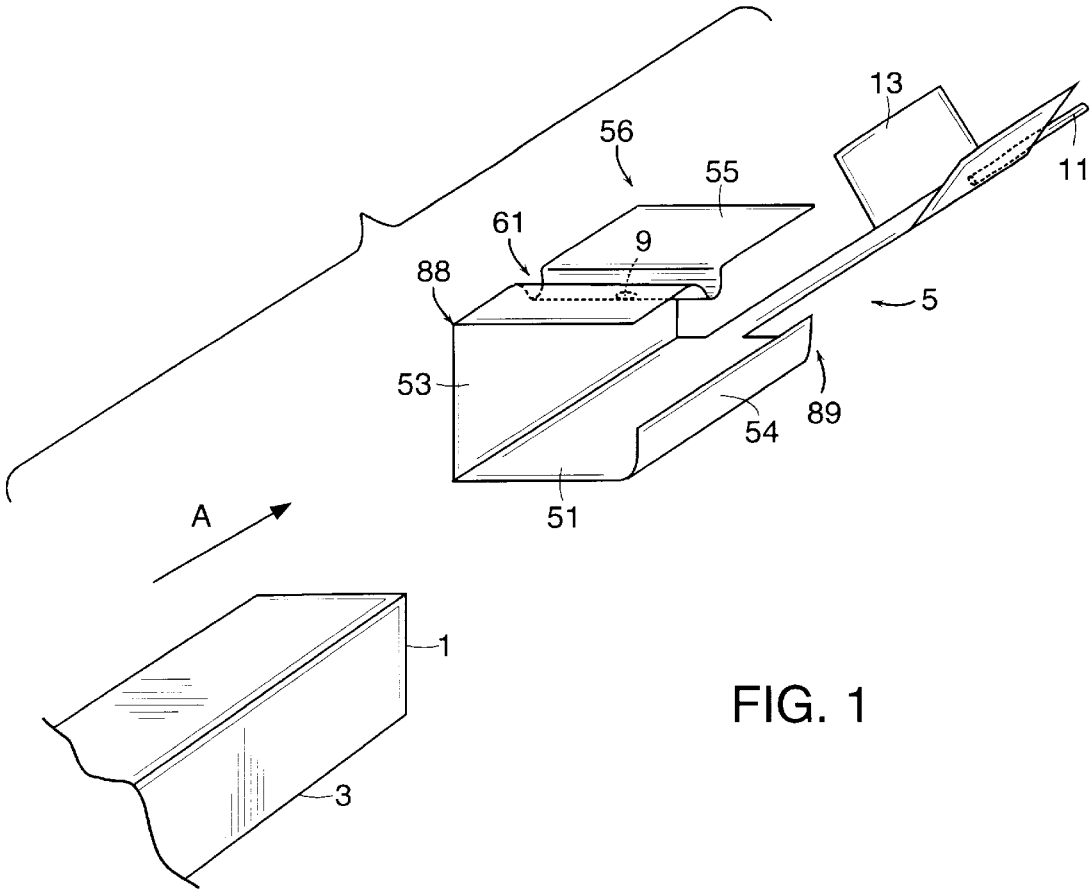
FIG. 1 is a drawing of a perspective view of an unassembled connection of the present invention.
Figure 2:
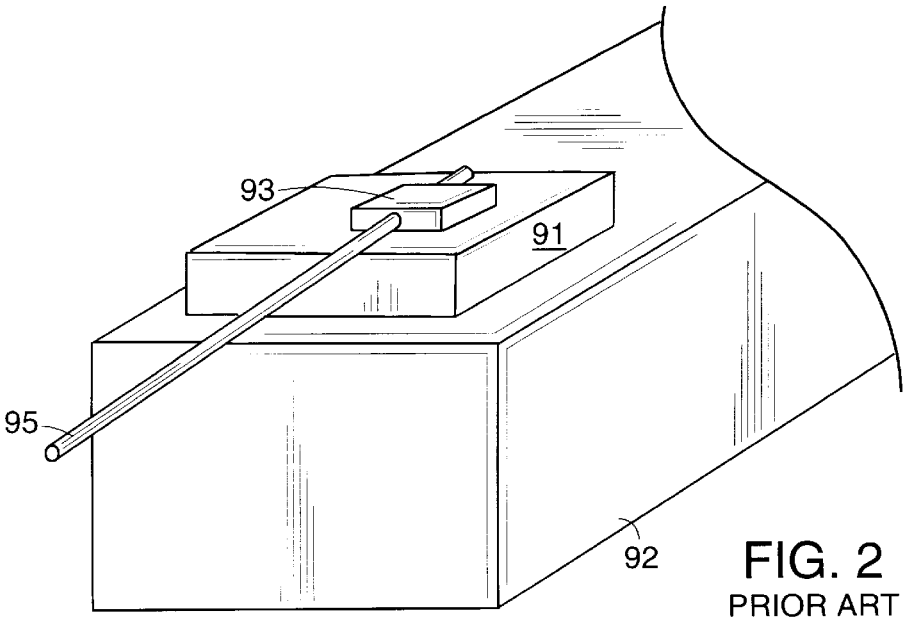
FIG. 2 PRIOR ART
FIG. 2 is a drawing of a prior art ceramic igniter connection system which uses solder.

Now referring to FIG. 1, in one preferred process of making the igniter, a ceramic hot surface element 3 (CHSE) having two essentially parallel ends 1 (or "legs") connected by a bridge is used. These legs are slid into the first end 88 of corresponding sleeves 56 of the leadframe 5. Next, braze (not shown) is first deposited into the hole 9 in the leadframe sleeve and then vacuum-fired to create both ceramic-braze and leadframe-braze bonds. Lastly, a one end 11 of a lead wire is placed on the V-shaped leadframe tab 13 and is mechanically crimped into place.

Figure 3:
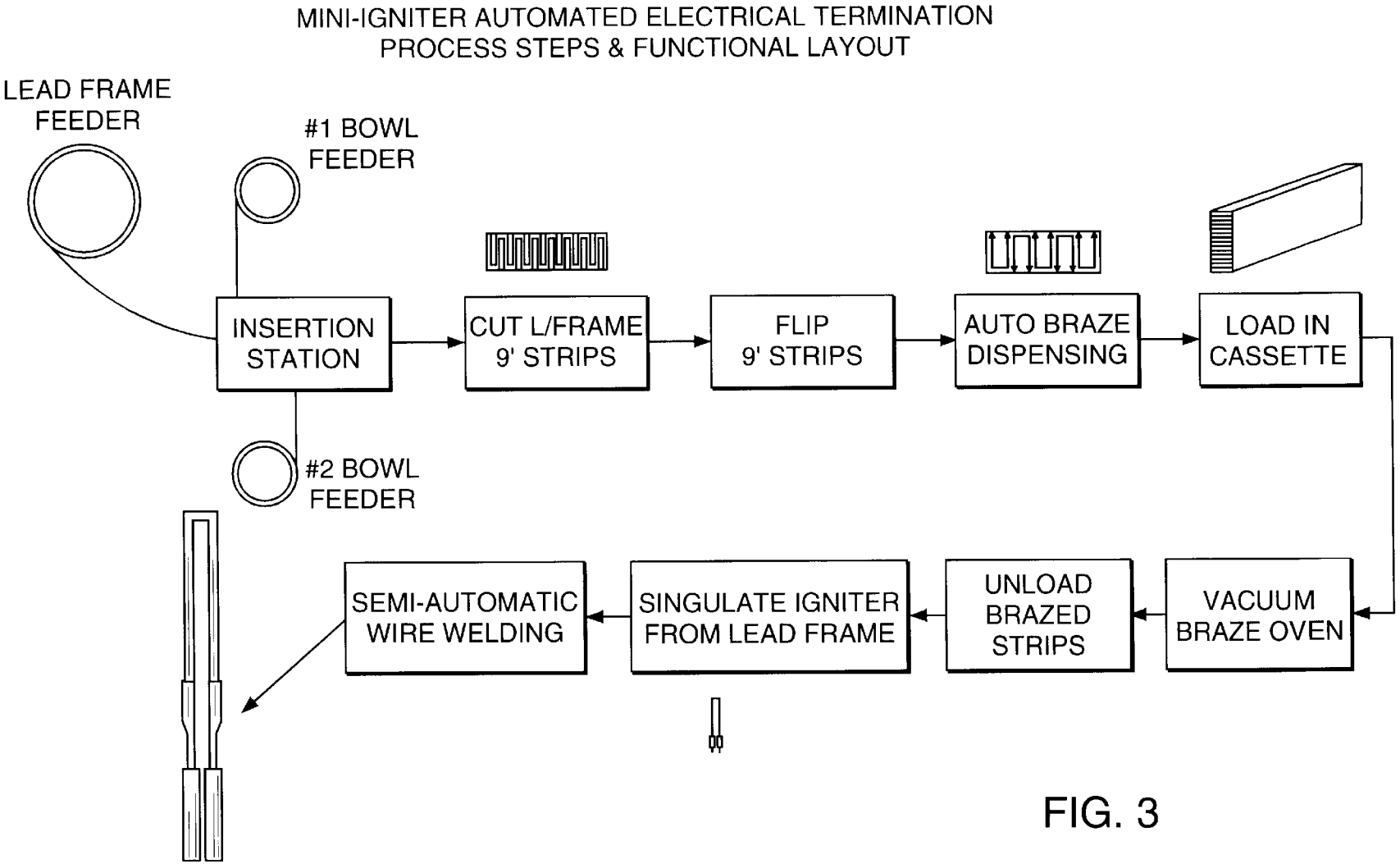
FIG. 3 is a flow sheet describing a preferred automated system for making the present invention.

In an especially preferred automated system for making the igniter of the present invention, a predetermined number of ceramic igniters are bowl fed into a precision linear track and are inserted into the sleeves of the corresponding plurality of leadframes attached together on a stamped leadframe reel. See FIG. 3. This combination then moves to a braze dispensing station, whereby braze is deposited into the roof holes of the leadframes. This assembly is then presented into a high temperature vacuum oven which ref lows the braze and creates both ceramic-braze and leadframe-braze bonds. Next, the assembly is presented to a singulation station wherein the metal ties between the leadframes on the reel are sliced to produce a plurality of independent igniters. Lastly, a lead wire is placed on the leadframe tab and is resistance welded into the tab.

Figure 4:
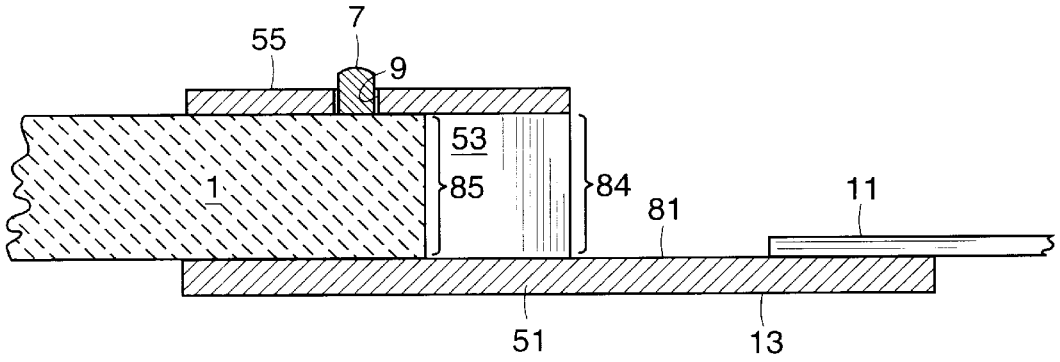
FIG. 4 is a drawing of an axial cross section of the assembly.
Figure 5:
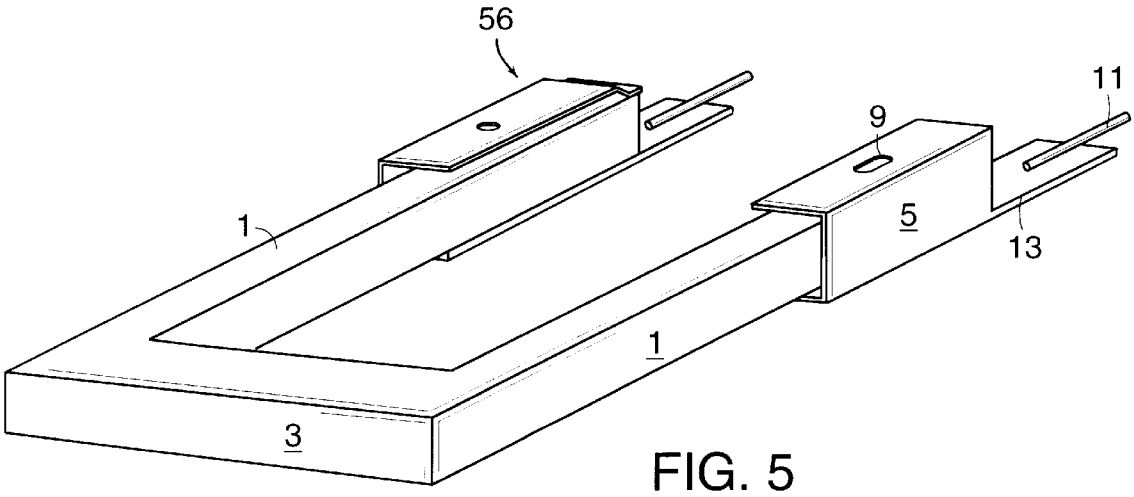
FIG. 5 is a perspective view of the entire assembly of FIG. 4.

Referring now to the preferred embodiments disclosed in FIGS. 1, 4 and 5, each leg 1 of the ceramic hot surface element 3 is permanently held in place within the sleeve 56 of the lead frame 5 by braze 7 residing within the hole 9 of the lead frame roof 55. A first end of lead wire 11 is electrically connected to the upper surface of tab portion 13 of the lead frame 15, and so is a means of providing electrical current to the hot surface element 3. The leadframe 5 has a flat base 51 having an upper surface 81 having a tab 13 at one end. The leadframe also has side wall 53 and lip 54 rising parallel to each other from the flat base 51. Roof 55 is connected to flat base 51 by side wall 53.

In FIG. 1, the base 51, sidewall 53, lip 54 and roof 55 form a sleeve 56 whose axial cross-section substantially corresponds to the axial cross-section of the CHSE leg 1. Depression 61 of FIG. 1 extending downward from roof 55 provides a means for making an interference fit with the leg of the igniter when the leg is inserted into the sleeve 56 in the A direction.

In FIG. 4, the base 51, sidewall 53 and roof 5 form the sleeve 56, and the interference fit is formed by selecting the height 84 of sidewall 53 to be slightly smaller than the thickness 85 of the leg 1 of CHSE 3.

Figure 6:
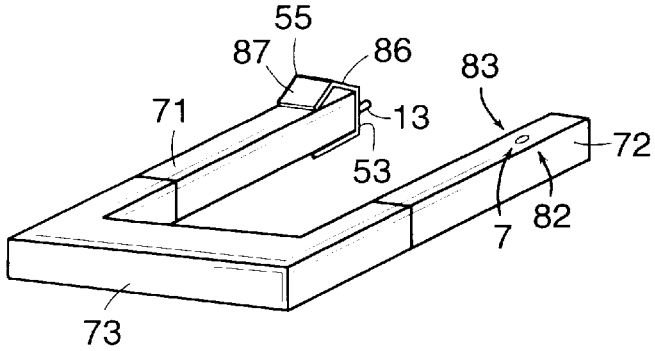
FIG. 6 is a perspective view of an embodiment of the present invention.

It is believed that the present invention can be usefully applied to make an attachment for any conventional ceramic hot surface element. However, because this process can be readily adapted to automation when the CHSE has two essentially parallel legs, the process has particular advantage when applied to CHSEs 4 having parallel legs. In some cases, the CHSE is a recrystallized SiC ceramic igniter, such as that disclosed in U.S. Pat. No. 3,875,477 ("Fredrikson"), the specification of which is incorporated by reference. In these SiC CHSEs, the conductive cold ends and the resistive zone are made of the same SiC material. In other embodiments, the CHSE is a fully dense ceramic igniter comprising either AlN/SiC/$MoSi_2$ or $Si_3N_4$/SiC/$MoSi_2$, such as that disclosed in U.S. Pat. No. 5,045,237 ("Washburn"), the specification of which is incorporated by reference. In the Washburn embodiments, the ceramic hot surface element comprises a pair of conductive (or "cold") ends 71 and 72 and a resistive hot zone 73 therebetween, as shown in FIG. 6.

In preferred embodiments, the hot zone comprises:

(a) between about 50 and about 75 vol % of an electrically insulating material selected from the group consisting of aluminum nitride, boron nitride, silicon nitride, and mixtures thereof, (b) between about 10 and about 45 vol % of a semiconductive material selected from the group consisting of silicon carbide and boron carbide, and mixtures thereof, and (c) between about 5 and about 25 vol % of a metallic conductor selected from the group consisting of molybdenum disilicide, tungsten disilicide, tungsten carbide, titanium nitride, and mixtures thereof.

In the more preferred embodiments involving AlN, the hot zone comprises a first resistive material comprising between 50 vol % and 75 vol % AlN, between 13 vol % and 41.5 vol % SiC, and between 8.5 vol % and 12 vol % $MoSi_2$. In more the preferred embodiments involving $Si_3N_4$,the hot zone comprises a first resistive material comprising between 50 vol % and 75 vol % $Si_3N_4$, between 15 vol % and 45 vol % SiC, and between 10 vol % and 25 vol % $MoSi_2$. In other embodiments, the hot zone further comprises between 1 v/o and 10 v/o alumina, preferably in accordance with U.S. Pat. No. 5,514,630, the specification of which is incorporated by reference herein.

The conductive cold ends 71 and 72 provide means for electrically connecting the CHSE to the leadframe and wire leads. Preferably, they also are comprised of AlN, SiC and $MoSi_2$, but have a significantly higher percentage of the conductive and semiconductive materials (i.e., SiC and $MoSi_2$) than do the preferred hot zone compositions. Accordingly, they typically have much less resistivity than the hot zone and do not heat up to the temperatures experienced by the hot zone. They preferably comprise a) from 20 to 65 v/o of a ceramic selected from the group consisting of aluminum nitride, silicon nitride and boron nitride, and mixtures thereof, and b) from about 35 to 80 v/o $MoSi_2$ and SiC in a volume ratio of from about 1:1 to about 1:3.

More preferably, the conductive ends comprise about 60 v/o AlN, 20 v/o SiC and 20 V/O $MoSi_2$. In preferred embodiments, the dimensions of conductive ends 9 and 13 are 0.05 cm (width)×4.2 cm (depth)×0.1 cm (thickness). Typically, the conductive cold ends have a room temperature resistivity of no more than 1 ohm-cm, preferably no more than 0.1 ohm-cm.

In making the present invention, the present inventors considered electrically connecting the hot surface element 3 to the leadframe 56 in a number of different ways. One method involved refractory metal reaction bonding, wherein the leg of a porous recrystallized SiC CHSE was notched, a strip of tungsten was laid in the notch, and a lead wire was resistance welded to the tungsten. However, it was found the resultant product suffered from severe oxidation. A second method involved using an active metal braze to connect a clip (made of either stainless steel, a BeCu alloy or a Ni/Fe alloy) to a porous recrystallized Sic igniter leg. However, it was found that the pull-off strength of the resultant igniters were extremely low. Accordingly, the present inventors learned that simply making a solderless lead-wire attachment to a CHSE is not a trivial exercise, even when using an active metal braze.

The metal braze must be not only electrically conductive, it must also be compatible with both the CHSE and the lead frame. That is, it must be able to bond with the ceramic and the lead frame to provide both mechanical integrity and electrical conduction, and it must have a CTE which is compatible with each as well. However, since both the lead frame and braze are typically metals, the suitability of the braze is determined by the suitability of the braze-ceramic bond. Generally, the braze composition is any conventional braze composition which forms an electrical connection with the legs of the CHSE. In some preferred embodiments, the braze must have a CTE which is within about 25% of the CTE of the ceramic.

To obtain a preferred required high degree of adhesion to the ceramic, the braze typically contains an active metal which can wet and react with the ceramic materials and so provide chemically bonded adherence thereto by filler metals contained in the braze. Without wishing to be tied to a theory, it is believed that the active metal braze also chemically reacts with the metals in the metallic leadframe and produces a chemical bond therebetween as well. Preferred active metal brazes are disclosed in U.S. Pat. No. 5,564,618, the specification of which is incorporated by reference. Examples of specific active metals include titanium, zirconium, niobium, nickel, palladium and gold. Preferably, the active metal is titanium or zirconium, more preferably titanium. In addition to the active metal, the braze also contains one or more filler metals such as silver, copper, indium, tin, zinc, lead, cadmium and phosphorous. Preferably, a mixture of the filler metals is used. Most preferably, the braze will contain titanium as the active metal and a mixture of silver and copper as filler metals. Generally, the braze will contain between about 0.1 and 5 weight percent(wt %) active metal and between 95 and 99.9 wt % filler metals. Some suitable brazes are commercially available under the trade name Lucanex from LucasMilhaupt, Inc. of Cudahy, Wis., and Cusil and Cusin of Wesgo, Inc. of Belmont, Calif. In preferred embodiments, the braze is Wesgo Cusin-1-ABA, available from Wesgo, Inc. of Belmont, Calif. Specific brazes found to be particularly useful in the present invention include Lucanex 721 and Cusil Braze, each of which contains about 70.5 wt % silver, about 27.5 wt % copper and about 2 wt % titanium.

In reflowing the braze after it has been deposited on the CHSE surface, care must be taken to properly control the time-temperature brazing profile. An incorrect profile can cause the braze to flow improperly, thereby causing electrical failure in the igniter. In some embodiments, the braze is reflowed at between about 805° C. and 850° C. and at a soak time of between about 0 minutes and 10–30 minutes (depending upon the time needed for the thermal mass to reach steady state) in a vacuum of no more than about $10^{-6}$ torr, and is cooled at a rate of between 2° C./minute and 20° C./minute. Although slower cooling rates are preferred, they are not especially critical. Preferably, the soak time and temperatures are set at the lower ends of these ranges described above. Also, the amount of braze is important. If an insufficient amount of braze is used, then the mechanical and electrical integrity of the bonds may be compromised. If excessive braze is used, then there is a danger that the braze-ceramic CTE mismatch will produce cracks in the area underlying the braze during the braze curing step. The appropriate amount of braze can typically be determined through standard finite element analysis techniques.

In addition, it was found that centering the braze 7 between the parallel edges 82 and 83 of the leg (as shown in FIG. 6) was also very important. If the braze is applied near an edge of the leg, the resulting stresses are not uniformly distributed and sharp stress maxima may be seen. In addition, the edges of the leg are often a more common source of machining flaws than the fairly flat surfaces of the leg. Accordingly, in some preferred embodiments, the braze is centered between the parallel edges the leg in order to reduce the possibility of breakage.

In applying the braze, it was found that the process of metallization was prohibitively long when the density of the ceramic hot surface element was about 85%. In contrast, when the igniter has essentially no open porosity (i.e., more than about 95% dense), the duration of the metallization step was commercially acceptable. Accordingly, in some preferred process embodiments, the ceramic igniter has essentially no open porosity.

Generally, the geometry of the termination can take on any shape, such as a flat surface, a U-shape or a tube. In some preferred embodiments, the termination includes a sleeve shape. In some embodiments (as in FIG. 4), the sleeve sidewall 53 can have a height 84 which is slightly smaller than the leg thickness 85, so that upon leg insertion, the sleeve tightly holds the leg in an interference fit and so provides advantages over a termination which is simply flat surface. Alternatively, the sleeve can have depressions 61 (as in FIG. 1) or clips 65 (as in FIG. 10) which employ interference fits to hold the leg in place.

In a simple sleeve embodiment in which the sleeve is an annular tube having no internal holes, attachment of the lead wire typically requires careful and time consuming mechanical crimping of the lead wire into the tube. Moreover, in this embodiment, the coating of unfired braze must first be applied to the legs of the ceramic igniter prior to their insertion into the tube. During insertion, the braze is often smeared over the leg, often reaching the problematic leg edges.

In contrast, in the leadframe embodiment of the present invention, the tab portion of the leadframe provides an easily accessible flat surface upon which to make the electrical connection, thereby eliminating the need for mechanical crimping. Moreover, the hole feature of the leadframe allows for controlled deposition of the braze after the leg is slid into the sleeve, thereby eliminating smearing. Therefore, in preferred embodiments, each sleeve has a transverse hole therethrough, and the chemical bonding step is performed by the steps of:

i) depositing an active metal braze in the hole after leg insertion, and ii) reflowing the braze.

Lastly, now referring to FIG. 1, depression 61 helps secure each leg 1 within its sleeve 56. Therefore, in especially preferred embodiments, the termination is a lead frame whose sleeve has a transverse hole, whose roof has a depression or clip extending therefrom, and a tab portion extending from the second end of the sleeve.

The leadframe needs to be electrically conductive (in order to carry current from the lead wire to the braze). However, it does not need to have especially great high-temperature oxidation resistance, and so it is typically made of metal. In some preferred embodiments, the metallic leadframe termination comprises an oxidation-resistant material selected from the group consisting of nickel-based compositions containing at least 85% nickel (preferably at least 95% nickel), Ni—Cr alloys, silver, gold and platinum. In some embodiments, it consists essentially of the oxidation resistant material which will not be susceptible to moisture at typical operating temperatures of between about 600° C. and 800° C. This material should have a melting point of at least 485° C., preferably at least 600° C. It typically has a CTE which is compatible with that of the braze. In one embodiment, the metallic termination is made of Alloy 42, a nickel-iron alloy available from Heyco Metals Inc. of Reading, Pa. In some embodiments, the leadframe comprises an underlying substrate made of a relatively inexpensive metal (such as copper or a copper-based alloy) and an overlying coat of a more expensive, more oxidation resistant material such as those disclosed above. There is typically no concern with the compatibility of these metallic termination materials and the active metal brazes.

In some embodiments, the CHSE has an insert between its legs, as disclosed in U.S. Pat. No. 5,786,565, the specification of which is incorporated by reference. In these embodiments containing this type of igniter, it is especially preferred that the leadframe sleeve consists essentially of three walls as in FIG. 5 (i.e., it has essentially no lip which would interfere with the easy insertion of the type of igniter.

In some embodiments, the igniter of the present invention is used as a plug-in type of igniter, like those disclosed in the Salzer patent discussed above. In these embodiments, one end of a pin made of a high temperature metal having a melting point of at least 600° C. (such as Ni—Cr) is attached to the tab as the lead wire. The other end of the pin is then used as the male connector for a plug-in connection.

Figure 7:
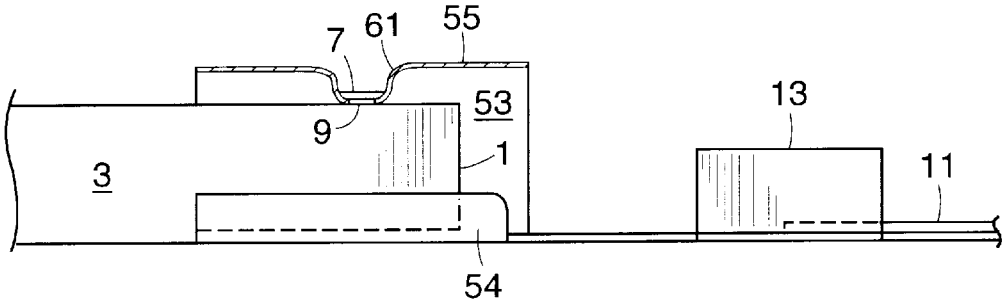
FIG. 7 is a drawing of a single depression embodiment of the present invention.
Figure 8:
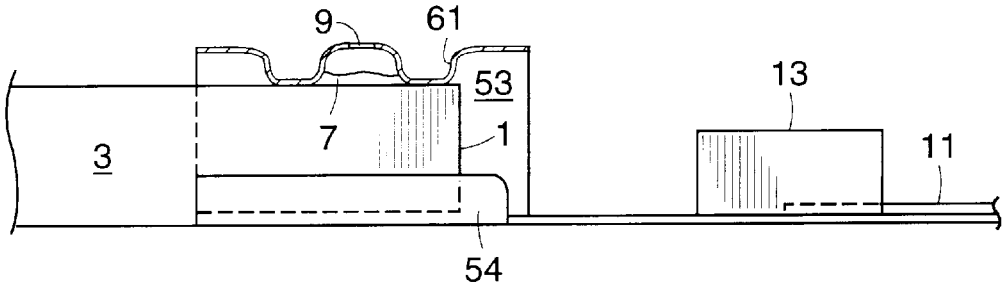
FIG. 8 is a drawing of a double depression embodiment of the present invention.

Because of the critical role played by the braze in providing both mechanical and electrical connection, it was initially believed that providing as much braze coverage as possible would produce a superior igniter. At the same time, it was noted that the single depression design of FIG. 7 necessarily constrained the coverage of the braze 7 to essentially the area of the hole 9. Accordingly, the roof of the leadframe was modified to contain two contact depressions and a braze hole therebetween. This modification is shown in FIG. 8. Because the braze hole 9 of FIG. 8 is now located between the two contact depressions 61, it is necessarily raised off the surface of the igniter leg, thereby allowing the braze 7 to freely spread during reflow and maximizing its coverage of the leg. Therefore, in some embodiments, the annulus defining the braze hole 9 does not contact the ceramic leg 1. In this case, the roof 55 of the leadframe has two depressions 61 and a braze hole 9 located therebetween, thereby raising the braze hole annulus off the leg and allowing unconstrained spreading of the braze during reflow.

In addition, if the lip is removed (so that the sleeve has only a base, a sidewall, and a roof, the igniter leg can be oriented perpendicular to the sidewall and inserted into the sleeve as well, thereby producing a fit as shown in FIG. 6.

This mode of insertion has particular advantage when the igniter leg has an irregular shape which makes difficult its insertion into the sleeve in a manner parallel to the sidewall. In this case, the parallel edges 82 and 83 of each leg define a central axis and the leg 1 is disposed in sleeve 56 so that the central axis is perpendicular to sidewall 53. The leadframe in this embodiment further has tab 13 which extends from sidewall 53, thereby aligning tab 13 with the central axis of the leg. This leg is held in place by an interference fit in which roof 55 also acts as a bidirectional clip extending first away from leg 1 and base 51, and then towards leg 1 and base 51 to contact leg 1.

By contrast, in FIG. 1, the parallel edges of each leg define a central axis and the leg 1 is disposed in sleeve 56 so that the central axis is parallel to sidewall 53.

Preferably, the igniter leg and the sleeve are dimensioned so that the leg is interference fit when inserted into the sleeve. This interference is advantageous because it fit provides stability to the pre-brazed assembly. The interference fit is preferably achieved by at least one of three means. In the first means, the interference is essentially achieved by an undersized sidewall (as in FIG. 4). That is, the height 84 of the sidewall is smaller than the thickness 85 of the leg, so that during insertion of the leg 1 into the sleeve the leg contacts both the roof 55 and base 51 (which flex to arrive at a slight angle to each other) before it touches the sidewall. In the second means, the interference is provided by a depression 61, as in FIG. 1. In this embodiment, the height of the sidewall 53 exceeds the thickness of the leg 1, and either the roof or base has either an internal depression which extends from that face towards the opposing leg to produce a roofbase clearance which is less than the thickness of the igniter. Therefore, when the igniter leg is inserted into the sleeve, it contacts the depression and the opposing wall to produce the interference fit. In the third means, the interference is provided by a uni-directional clip, as in FIG. 10. In this embodiment, the height of the sidewall exceeds the thickness of the leg, and either the roof or base has either an external clip 65 which extends from that face towards the opposing leg to produce a roof-base clearance which is less than the thickness of the igniter. Therefore, when the igniter leg is inserted into the sleeve, it contacts the clip and the opposing wall to produce the interference fit. As a variation of the clip embodiment, a bi-directional clip may be used which has a first portion 86 which extends away from the opposing face and then a second portion 87 which extends back towards the opposing face, as in FIG. 6.

The above-discussed leadframe of FIG. 8 has two distinctive features. First, its roof has two depressions 61. When a properly dimensioned igniter is slid into the leadframe, the double depression feature produces an interference fit with the igniter and so holds it in place. Second, the roof also has a hole 9 through which braze 7 may be conveniently applied. Although these two features provide significant benefits, the present inventors set out to improve this design and initially identified three areas of concern: mechanical stresses produced by the interference fit used to secure the ceramic leg in the leadframe; thermal stresses produced by the brazing activity; and tensile stresses in the assembled part due to in-service use. The present inventors then analyzed each of these three stresses situations for the igniter substantially shown in FIG. 8 with the help of finite element analysis (FEA).

Regarding the mechanical stresses produced by the interference fit, it was found that the interference will induce innocuous compressive mechanical stresses within the ceramic over the actual contact area with the ceramic, but will also induce some harmful tensile stresses in the immediate area surrounding the contact area. However, the actual magnitude of these tensile stresses is not very significant. Therefore, the use of an interference fit per se will not automatically produce important stresses in these leadframe designs.

Brazing-related stresses were found to be the most important stresses of any aspect of these leadframe-containing igniters. Simply, the steps of reflowing the braze at about 850° C. and subsequently letting it cool to room temperature produces significant thermal stresses over the braze footprint and tensile stresses over its periphery. These stresses are on the order of about 200 MPa. The brazing-induced stresses on the ceramic leg and on the ceramic-braze interface were found to be less important. Therefore, the braze itself was identified as the feature of the igniter most susceptible to brazing-related breakage.

Additional analysis led to the conclusion that simply substituting different ceramic or leadframe materials would not lead to appreciable changes in the magnitude of the stresses impacting the braze. Rather, appropriate management of these stresses could only be realized by changing features of the braze. In particular, the most important factors of these features were found to be:

a) the control of the areal surface coverage of the braze, b) the type of braze, and c) the thermal expansion coefficient of the braze.

Surprisingly, finite element analysis of the double depression design determined that a tradeoff exists in the amount of braze which covers the surface of the leg. The extent of braze coverage impacts the electrical resistance of the igniter, the stresses imparted to the ceramic igniter, and the strength of the braze to resist brazing stresses. Therefore, if there is too little coverage of the leg, the electrical connection is compromised and the braze is weak. Conversely, if there is too much braze, the stresses will hurt the integrity of the igniter. Accordingly, there is a need to precisely control the amount of braze that is used.

In light of this need for precision placement of the braze, the present inventors examined the location of the reflowed braze in the double depression igniter of FIG. 8 and found that, after reflow of the braze, the location of the braze was extremely variable. Given the need to precisely control the area and placement of the braze, the location of the braze hole was reconsidered. The present inventors noted that, in the double depression style leadframe, the hole was raised above the surface of the igniter and speculated that the space between the bottom of the hole 9 and the leg 1 allowed the braze to flow uncontrolled. Accordingly, the inventors re-considered the single depression design of FIG. 7. In contrast to the double depression design, when the braze is reflowed in a single depression design, the contact between the ceramic leg and the annulus defining the braze hole keeps the braze in the precise desired area, and so variability in the braze location is eliminated. Accordingly, in some preferred embodiments, the annulus defining the braze hole 9 is in contact with the ceramic leg 1.

Finite element analysis of the double depression design further revealed that the typical brazing operation produced a residual stain in the braze of about 15–20%, which is significant. As noted above, increasing the area of the braze would reduce this value, but would also increase the stress on the igniter. In light of this tradeoff, it was decided that using a braze with an increased failure strain would be more acceptable. Therefore, in preferred embodiments of the present invention, the braze has a residual strain of at least 22%, more preferably at least 25%.

Although the stress experienced by the braze appears to be the most important issue in the brazing operation, there is nonetheless some stress in the igniter produced during brazing , particularly in the region of the ceramic (on the order of microns) which abuts the edge of the braze edge. The CTEs of the braze and ceramic in this evaluation differed by about 50% (i.e., the lower value was half that of the higher value). Since the residual stress on this region can be reduced by further reducing the CTE mismatch, in some embodiments, the CTE mismatch between the braze and ceramic is less than 25% over the temperature range of 22–850° C.

Regarding the in-service stresses of the double depression design, the major concern was that CTE mismatches between the ceramic leg, the braze, the leadframe material and the encapsulant would produce high stresses. Finite element analysis demonstrated that the major stresses resulting therefrom would reside in the ceramic, but would not be very large, and so the probability of survival was estimated at nearly 100%. Nonetheless, it is believed that these stresses could be further reduced if the CTE mismatch between the ceramic leg and the braze material were further reduced. Therefore, in some embodiments, the CTE mismatch between the ceramic leg and the braze is less than 25% over the temperature range of 22–850° C.

Although the use of a braze hole in the single depression design provides the skilled artisan with a convenient means for precisely locating the braze, it nonetheless contains limitations. In particular, when braze is deposited through the braze hole of the single clip design of FIG. 7 (which controls the area of spread), the electrical connection between the braze and leadframe occurs only around the periphery of the braze. This periphery is very thin. Since electricity must travel through this thin region, the region has a high electrical resistance. Accordingly, this design requires the use of a relatively large amount of braze in order to lower the resistance of this region. However, because a large amount of braze may cause CTE-related stress problems, there is a parallel desire to minimize the amount of braze used. Thus, the necessity of electrical conduction through the thin edge of the braze presents a problem.

Figure 9:
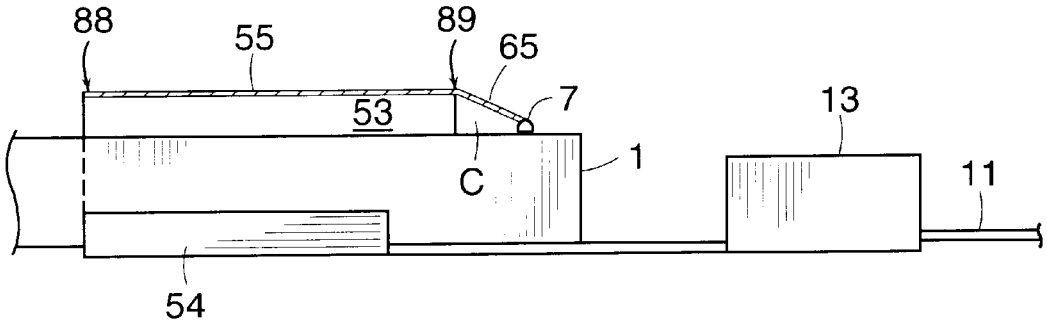
FIG. 9 is a drawing of a single point contact embodiment of the present invention.

Therefore, in some embodiments (as shown in FIG. 9), the leadframe and igniter leg are placed in electrical connection via the large surface area face of the braze, and this is done by using what is called a "single point contact". The single point contact is produced by contacting a hemisphere-shaped braze 7 with a solid clip 65 on the leadframe. Because the electrical contact proceeds from the clip 65 through substantially entire hemisphere of the braze 7, the braze is more efficient electrically and so less braze need be used. Accordingly, the "single point" design has the advantage of minimizing the amount of braze needed to provide acceptable electrical resistance at the braze connection. In this design, leg 1 is slid past both first end 88 and second end 89 of the leadframe sleeve.

Figure 10:
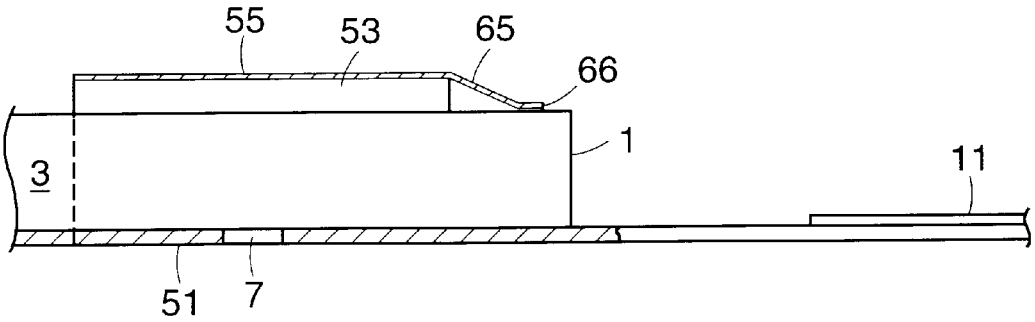
FIG. 10 is a drawing of an embodiment of the present invention in which the braze hole and clip are on opposite sides of the leadframe sleeve.

The single point design of FIG. 9 can be further improved by using a clip having a flat contact face 66, as shown in FIG. 10. The flat contact face has the effect of further flattening the braze, thereby reducing the resistance of the braze and allowing for even more effective use of the braze.

Even though the single point contact leadframe design of FIG. 9 provided many advantages over the single and double depression embodiments, it still possessed features which could cause problems for typical igniter applications. Thus, the present inventors set out to eliminate these problems and produced an improved leadframe design shown in FIG. 10. These new features of the improved igniter will now be discussed.

Despite the improved single point design of FIG. 9, the present inventors found that electrical integrity problems still remained during use, and hypothesized that these problems were due to lack of mechanical integrity in the clip-braze-leg connection. First, the present inventors noted that, for each of the designs of FIGS. 1, 7–9, the igniter is ultimately fully embedded in cement (shown as C in FIG. 9). The present inventors then hypothesized that, when the igniter is heated to service temperatures, the high CTE of the expanding cement located between the clip and the ceramic leg sometimes causes the clip to separate from the braze, thereby destroying the electrical connection at the braze location in the disconnect process.

In addition, it was found that the contact resistance of the single point embodiments was undesirably about 2–4 times higher than that of the single depression design of FIG. 1 (which used a braze hole to control the braze area). Without wishing to be tied to a theory, it is believed that the spring contact embodiment relies more heavily upon surface contact conductivity than does the hole embodiment, and so the conductivity of this joint is more dependent upon the conductivity of the leadframe material and accordingly is prone to leadframe oxidation.

Therefore, the electrical connection between the hot surface element and the leadframe is most preferably made by providing a braze within the hole of the leadframe. In the preferred embodiment (as shown in FIG. 10), the braze is located away from the clip, preferably in a hole 7 in the base 51 opposite the roof 55, wherein the annulus of the leadframe contacts the ceramic leg. In this embodiment, cement can not get between the leadframe and ceramic leg in the vicinity of the braze. Thus, in this embodiment, even if the high CTE cement pulls the opposing clip away from the igniter leg during service, the critical leadframe-braze-leg connection is not affected by that disconnect and the electrical integrity of the braze is maintained.

In the design of FIG. 10, a clip 65 having a flat surface area contact 66 provides for greater mechanical stability during pre-brazing handling.

Another problem with the single depression, double depression and single point contact designs relates to the use of inner wall 54 (or "lip") in each leadframe. As noted above, these lips help maintain the stability of the assembly during pre-brazing handling and to insure that the igniter legs remain straight. However, when leadframes 56 are set in place over the end of each leg of a hairpin-style igniter, inner walls 54 of the conductive leadframe face each other and come very close to each other. Because the unframed distance from leg to leg is already typically very small (only about $^{37}/_{1000}$ of an inch) and each leadframe inner wall has a significant thickness (about $^{10}/_{1000}$ of an inch), the presence of the inner walls significantly decreases the effective distance between the legs by about 50%, thereby significantly increasing the danger of causing a short (via wall-to-wall contact). This danger is particularly problematic because the legs of hairpin igniter designs are known to have the ability to flex somewhat. In fact, in the initial testing of the design substantially shown in FIG. 1, the igniters were plagued by shorting in some high potential testing situations.

In addition, the lip 54 of the igniter of FIG. 1 presents an additional design handicap. Although many ceramic igniters have a hairpin geometry, other ceramic igniters (such as those disclosed in U.S. Pat. No. 5,786,565) contain a solid insert between their legs. Although this insert may provide additional support for the igniter, it presents an obstacle for the easy insertion of the igniter legs into the leadframes in the A direction.

Lastly, it was believed that the presence of these lips hindered the flow of refractory cement used to pot the igniter.

Therefore, in the preferred embodiment (as shown in FIGS. 5 and 10), the inner lip of each leadframe is removed, thereby producing a leadframe having only three walls. The lip-less design of FIGS. 5 and 10 maintains the effective distance between the conductive ceramic legs (thereby eliminating the increased risk of shorting) and allows for easy insertion of hairpin style ceramic igniters which have inserts disposed between their ceramic legs.

Another problem with the single depression and double depression designs of FIGS. 1, 7–9 relates to their use of circular braze holes. A circular hole has the advantages of maximizing the effectiveness of the braze's ability to make a good electrical connection, and of typically providing even stresses at its edges. However, in cases wherein relatively large contact areas of braze are required, the continual expansion of the circle will bring the edge of the braze towards the edge region of the igniter leg. Since the edge of the leg is known to contain a relatively high frequency of machining related flaws, the expansion of the braze into the edge region is undesirable.

Therefore, in one preferred embodiment (as shown in FIG. 5), the braze hole is elongated along the direction of the leg. This has the advantage of increasing the surface coverage of the braze without getting too close to the problematic side edges of the leg. Therefore, in some embodiments, the braze coverage is characterized by a non-equiaxed pad having an aspect ratio of at least 1.5:1 whose major axis runs along the length of the leg. Preferably, the shape is an oval.

Another problem with the single clip design of FIG. 1 relates to the use a V-shaped tab 13. As noted above, a lead wire is placed in the V-shaped trough of tab 13 and then the sidewalls of the trough are mechanically squeezed together, thereby producing a mechanically-secure electrical connection between the leadframe and the leadwire. However, it was found that the force of this assembly step was so significant that it often led to fracture of the igniter and/or the flowed braze. In addition, it was found that the security of this mechanical connection was subject to variability, thereby leading to undesired variability in the electrical properties of the igniter.

Therefore, in the preferred embodiment (as shown in FIG. 5), the V-shaped trough is eliminated and replaced with a simple flat tab 13. In this embodiment, the lead wire-leadframe connection is made by resistance welding the lead wire to the lead frame tab. Because the force used to make this connection is low, the danger of breaking either the igniter leg or the braze is likewise low. Moreover, it was found that the welding connection produces a fairly reproducible result in terms of electrical properties. For these two reasons, the resistance welded-tab option is superior to the V-shaped trough embodiment. Thus, in preferred embodiments, the leadframe has a tab 13 and the leadwire is resistance welded to the tab.

Another problem with the single clip design of FIG. 1 relates to its relative inability to accommodate a plurality of different igniter designs having different distances between the centerlines of their legs. As noted above, it is desirable to center the braze pad upon each ceramic leg. However, it is also desirable to use the same set of leadframes for as many different igniter designs as possible. Since ceramic igniters are available in any number of leg spacings and leg thicknesses, the distance between the centerlines of the legs will vary from igniter to igniter. Accordingly, using a single set of preconnected leadframes (which have a fixed distance between their respective centered braze pad holes centered on the roofs) will not provide the desired centering of the braze pad upon the igniter legs for each design.

Because the desirability of using the same basic set of leadframes for as many different igniter designs as possible is great, the present inventors decided vary the location of the braze pad hole to locations which are not in the middle of the leadframe in order to insure that the braze would always be centered upon the underlying ceramic leg. Therefore, in some embodiments (as in FIG. 5), the braze hole 9 is not centered upon the roof of the leadframe.

The igniters of the present invention may be used in many applications, including gas phase fuel ignition applications such as furnaces and cooking appliances, baseboard heaters, gas or oil boilers and stove tops. Because the system no longer contains the temperature-sensitive solder layer (which melts at about 635° C.), the system can be used in applications in which the service atmosphere exceeds 635° C. This feature carries particular advantage in stove top range applications, wherein the temperature in the area of the termination is in excess of 635° C.

We claim:

1. An electrical connection for a ceramic hot surface element, comprising:

a) an electroconductive ceramic having a first end, b) an electroconductive active metal braze contacting at least a portion of the first end, and c) a metal termination contacting the active metal braze, wherein the metal termination is chemically bonded to the active metal braze.

2. A ceramic hot surface element connection, comprising:

a) an electroconductive ceramic having first and second ends, b) a first electroconductive active metal braze pad contacting at least a portion of the first end, c) a second electroconductive active metal braze pad contacting at least a portion of the second end, d) a first metal termination contacting the first active metal braze pad, and e) a second metal termination contacting the second active metal braze pad, wherein each metal termination is chemically bonded to its corresponding active metal braze pad.

3. The connection of claim 2 wherein each metal termination comprises a sleeve having a first end and a second end, and wherein each end of the electroconductive ceramic is received in the first end of its respective sleeve.

4. The connection of claim 3 wherein each sleeve has a transverse hole, and wherein each braze pad resides substantially in the hole and contacts the end of the ceramic received in the sleeve.

5. The connection of claim 4 further comprising a lead wire having a first end, each metal termination further comprising a tab extending from the second end of each sleeve, and wherein the first end of the lead wire is electrically connected to the tab.

6. The connection of claim 5 wherein the conductive ceramic comprises silicon carbide.

7. The connection of claim 5 wherein the first and second ends of the conductive ceramic comprise:

a)from 20 to 65 v/o of a ceramic selected from the group consisting of aluminum nitride, silicon nitride and boron nitride, and mixtures thereof, and b) from about 35 to 80 v/o $MoSi_2$ and SiC in a volume ratio of from about 1:1 to about 1:3.

8. The connection of claim 7 wherein active metal braze comprises:

a) between about 0.1 wt % and 5 wt % active metal selected from the group consisting of titanium, zirconium, niobium, nickel, palladium and gold, and mixtures thereof, and b)between about 95 wt % and 99.9 wt % filler metals selected from the group consisting of silver, copper, indium, tin, zinc, lead, cadmium and phosphorous, and mixtures thereof.

9. The connection of claim 8 wherein the lead frame comprises a metal selected from the group consisting of nickel-based compositions containing at least 85% nickel, Ni—Cr alloys, silver, gold and platinum.

10. The connection of claim 3 wherein each sleeve comprises:

a) a base having a substantially flat upper surface, b) a sidewall rising substantially perpendicular from the base, and c) a roof connected to the sidewall, the roof being substantially parallel to the base.

11. The connection of claim 10 wherein the roof comprises a clip extending towards the base.

12. The connection of claim 11, wherein each base has a transverse hole, and wherein each metal pad resides substantially within its respective hole and contacts the end of the ceramic received in its respective sleeve.

13. A ceramic igniter comprising:

a) an electrically conductive ceramic comprising two cold ends and a resistive zone therebetween;

b) a pair of terminations, each termination comprising a sleeve having a first end and a second end, wherein each end of the electroconductive ceramic is permanently received in the first end of and is in electrical connection with its respective sleeve, wherein each termination is a metallic termination, the igniter further comprising a pair of metal pads, each metal pad contacting its respective ceramic end and its respective metallic termination to provide electrical connection between the ceramic end and metallic termination, and wherein each sleeve has an annulus defining a transverse hole, and wherein each metal pad resides substantially in its respective hole and contacts the end of the ceramic received in its sleeve, and wherein each annulus contacts its respective ceramic end.

14. The ceramic igniter of claim 13 further comprising a pair of lead wires, each lead wire having a first end, each metal termination further comprising a tab extending from the second end of each sleeve, the tab having an upper surface, and wherein the first end of each lead wire is electrically connected to the upper surface of its respective tab.

15. The igniter of claim 14 wherein the conductive ceramic comprises silicon carbide and wherein each metal pad comprises an active metal braze.

16. The igniter of claim 15 wherein the first and second ends of the conductive ceramic each comprise:

a)from 20 to 65 v/o of a ceramic selected from the group consisting of aluminum nitride, silicon nitride and boron nitride, and mixtures thereof, and b) from about 35 to 80 v/o $MoSi_2$ and SiC in a volume ratio of from about 1:1 to about 1:3.

17. The igniter of claim 16 wherein the active metal braze comprises:

a) between about 0.1 wt % and 5 wt % active metal selected from the group consisting of titanium, zirconium, niobium, nickel, palladium and gold, and mixtures thereof, and b)between about 95 wt % and 99.9 wt % filler metals selected from the group consisting of silver, copper, indium, tin, zinc, lead, cadmium and phosphorous, and mixtures thereof.

18. The igniter of claim 17 wherein each lead frame comprises a metal selected from the group consisting of nickel-based compositions containing at least 85% nickel, Ni—Cr alloys, silver, gold and platinum.

19. The igniter or claim 13 wherein each sleeve comprises:

a) a base having a substantially flat upper surface, b) a side wall rising substantially perpendicular from the upper surface, and c) a roof substantially parallel to the flat upper surface of the base and connected the side wall.

20. The igniter of claim 19 wherein each ceramic leg is interference fit within its respective sleeve.

21. The igniter of claim 20 wherein each sidewall has a height and each leg has a thickness, and wherein the height of each sidewall is smaller than the thickness of its respective leg, and wherein each ceramic leg contacts its respective roof and base to form the interference fit.

22. The igniter of claim 20 wherein each sleeve further comprises a clip having a first end extending from its roof and a second end, wherein at least a portion of each clip extends towards its base, and wherein each ceramic end contacts its base and the second end of its clip to form the interference fit.

23. The igniter of claim 20 wherein each roof comprises a depression extending from the roof towards its base, and wherein each ceramic end contacts the depression and its base to form the interference fit.

24. The igniter of claim 23 wherein each depression contains an annulus defining a transverse hole, each metal pad resides substantially in its hole and contacts the ceramic end received in its sleeve, and wherein each annulus contacts its respective ceramic end.

25. The igniter of claim 23 wherein each roof comprises two depressions extending downwards towards their respective bases, and each ceramic end is interference fit with its depressions.

26. The igniter of claim 25 wherein each roof further comprises an annulus defining a transverse, each hole being between its respective two depressions, wherein each metal pad contacts the end of the ceramic received in its sleeve, and wherein each annulus does not contact its respective ceramic end.

27. The igniter of claim 19 wherein each ceramic end defines a leg having a central axis, and wherein each leg is disposed in its respective sleeve and its central axis is substantially parallel to its respective sidewall.

28. The igniter of claim 19 wherein each base has no lip extending therefrom, wherein each ceramic end defines a leg having a central axis, and wherein the leg is disposed in its respective sleeve and its central axis is substantially perpendicular to its respective sidewall.

29. The igniter of claim 19 wherein the CTE of the metal pad is within 25% of the CTE of the ceramic.

30. The igniter of claim 19 wherein each end of the ceramic is a leg having a pair of parallel edges, and wherein the metal pad is centered between the parallel edges.

31. The igniter of claim 19 wherein each ceramic end has a density which is at least 95% of theoretical density.

32. The igniter of claim 19 wherein each metal pad has a failure strain of at least 22%.

33. The igniter of claim 19 wherein each roof comprises a clip extending downwards towards its base to form a lower face, wherein each metal pad contacts both the lower face of its clip and the end of the ceramic received in its sleeve.

34. The igniter of claim 33 wherein each lower face is substantially parallel to the upper face of its base.

35. The igniter of claim 19, wherein each ceramic leg comprises first and second surfaces, each roof comprises a clip extending downwards towards its base to form a lower face, each clip contacting the first surface of its respective ceramic end, wherein each base further comprises an annulus defining a transverse hole, wherein a metal pad resides substantially in each hole and contacts the second surface of the ceramic received in its sleeve, and wherein the annulus of each base contacts its ceramic leg.

36. The igniter of claim 35 wherein the first and second surfaces of each ceramic leg are opposing surfaces.

37. The igniter of claim 19 wherein each sleeve consists essentially of:

a) a base having a substantially flat upper surface, b) a side wall rising substantially perpendicular from the upper surface, and c) a roof substantially parallel to the flat upper surface of the base and connected the side wall.

38. The igniter of claim 37 wherein the igniter further comprises an insert disposed between the ends of the ceramic igniter.

39. The igniter of claim 19 wherein each end of the ceramic is a leg having a pair of substantially parallel edges and each metal pad which contacts its respective leg forms an elongated surface between the substantially parallel edges of its respective leg, each elongated surface defining an axial length and a radial length, wherein each axial length is greater than its respective radial length.

40. The igniter of claim 39 wherein each axial length is greater than 1.5 times its respective radial length.

41. The igniter of claim 39 wherein each metal pad has an oval shape.

42. The igniter of claim 19 further comprising a pair of lead wires, each lead wire having a first end, each sleeve further comprising a tab extending from the second end of its sleeve, the tab having a flat upper surface and wherein the first end of each lead wire is resistance welded to the flat upper surface of its respective tab.

43. The igniter of claim 19 wherein each base has two substantially parallel edges, wherein each end of the ceramic is a leg having a pair of parallel edges, and wherein the parallel edges of each base are substantially parallel to the parallel edges of its leg.

44. The igniter of claim 43 wherein each base further comprises a transverse hole, and wherein each hole is not centered between the parallel edges of its respective base.

45. The igniter of claim 19 further comprising a lip rising substantially perpendicularly from each base in a plane substantially parallel to the sidewall.

46. A process for making a ceramic igniter termination, comprising the steps of:

a) providing a ceramic igniter having first and second ends, each end having an outer surface, b) providing a pair of sleeves, each sleeve having an inner surface corresponding substantially to the outer surface of the first and second ends, c) inserting the first and second ends of the ceramic igniter into the pair of sleeves, d) chemically bonding the inner surface of the sleeve to the outer surface of the leg received therein.

47. The process of claim 46, wherein each sleeve has a transverse hole therethrough, and wherein the chemical bonding step is performed by the steps of:

i) depositing an active metal braze in the hole after step c), and ii) reflowing the braze.

48. The process of claim 46, wherein the chemical bonding step is performed by the steps of:

i) coating the ends of the ceramic element with an active metal braze prior to step c), and ii) reflowing the braze after step c).

49. The process of claim 46 wherein the ceramic igniter has essentially no open porosity.

* * * * *